United States Patent [19]

Wasek

[11] Patent Number: 5,050,253

[45] Date of Patent: Sep. 24, 1991

[54] ADJUSTABLE VANITY

[76] Inventor: Gregory A. Wasek, 3350 Tracy, Sterling Heights, Mich. 48310

[21] Appl. No.: 510,953

[22] Filed: Apr. 19, 1990

[51] Int. Cl.[5] ..... A47K 1/05

[52] U.S. Cl. ..... 4/645

[58] Field of Search ..... 4/645, 307, 312, 480, 4/564, DIG. 2; 248/297.1, 125

[56] References Cited

U.S. PATENT DOCUMENTS 2,716,757 9/1955 Eriksson .
2,817,094 12/1957 Lessley .
3,011,177 12/1961 Haughey .
3,118,147 1/1964 Larkin .
3,456,264 7/1969 Flagg .
3,473,173 10/1969 Maciulaitis et al. .
3,486,175 12/1969 Schwartz .
4,233,693 11/1980 Stocklow .
4,381,714 5/1983 Henneberg et al. ..... 108/147

*Primary Examiner*—Henry J. Recla
*Assistant Examiner*—Scott Flanders
*Attorney, Agent, or Firm*—Harness, Dickey & Pierce

[57] ABSTRACT

A height-adjustable sink assembly capable of continuously variable adjustment through a predetermined range of motion. The present invention includes a sink coupled to a linear motion mechanism for reciprocal movement relative thereto. The sink is supported by at least one force generating device which is actuated in response to a remotely located switch assembly. The force generating device selectively permits and restricts reciprocal adjustable motion of the sink.

16 Claims, 3 Drawing Sheets

ADJUSTABLE VANITY

BACKGROUND AND SUMMARY OF THE INVENTION

The present invention relates generally to a vanity or wash basin and, more particularly, to a height-adjustable vanity or wash basin adapted to be vertically movable for selective use by adults, children and persons confined to wheelchairs.

Conventional sinks and vanities are routinely mounted at a standardized vertical height relative to the floor. Typically, the standardized height is predicated on convenient use by average size adults. However, such mounting makes it extremely difficult for people confined to wheelchairs, disabled persons, small children or below average size persons to use the vanity or sink. Therefore, various height-adjustable wash basins, vanities, or the like, have been disclosed in the art to provide vertical adjustability. Furthermore, with increased public awareness of the needs of handicapped individuals, it is apparent that such devices will be increasingly utilized in future construction.

Herebefore, several adjustable sink devices have been disclosed. Specifically, U.S. Pat. No. 4,233,693 discloses a mechanical latching mechanism associated with a wash basin for providing incremental height adjustment. Likewise, U.S. Pat. No. 3,486,175 discloses various alternatives for providing a vertically adjustable sink.

Although the aforenoted reference devices perform satisfactorily, it is desirable to provide further improvements in the design and operation of adjustable vanities, wash basins, sinks, and the like. Therefore, it is desirable to provide an improved height-adjustable vanity which is adapted to provide continuously variable height adjustment within a predetermined range of vertical motion. In this regard, manufacturers are constantly striving for easier production, low cost, simplicity and reliability of the hardware components and in the operative function of the adjustable apparatus.

Accordingly, it is a primary object of the present invention to overcome the disadvantages of the prior art and provide an improved height-adjustable vanity mechanism. In general, this is accomplished by providing an infinitely adjustable, vertically movable vanity assembly and a method of utilization of the same.

Another object of the present invention is to provide an apparatus capable of maintaining the sink, vanity, or the like in a fixedly locked condition when positioned at a desired height.

An advantage of the present invention is that it is ideally suited to allow a variable range of height adjustment to accommodate the needs of varying sized individuals. Furthermore, the present invention is advantageous in that it is compatible with many sinks, vanities and counter tops which presently are commercially available. Additionally, the adjustable sink is extremely simple in structure and relatively inexpensive for use in both private and public washroom facilities.

Additional objects, benefits, and advantages of the present invention will become apparent to those skilled in the art from the subsequent description of the preferred embodiments, and the appended claims, taken in conjunction with the accompanying drawings.

BRIEF DESCRIPTION OF THE DRAWINGS

FIG. 8 is a perspective view of a second embodiment of the present invention.

DETAILED DESCRIPTION OF THE PREFERRED EMBODIMENTS

Figure 1:
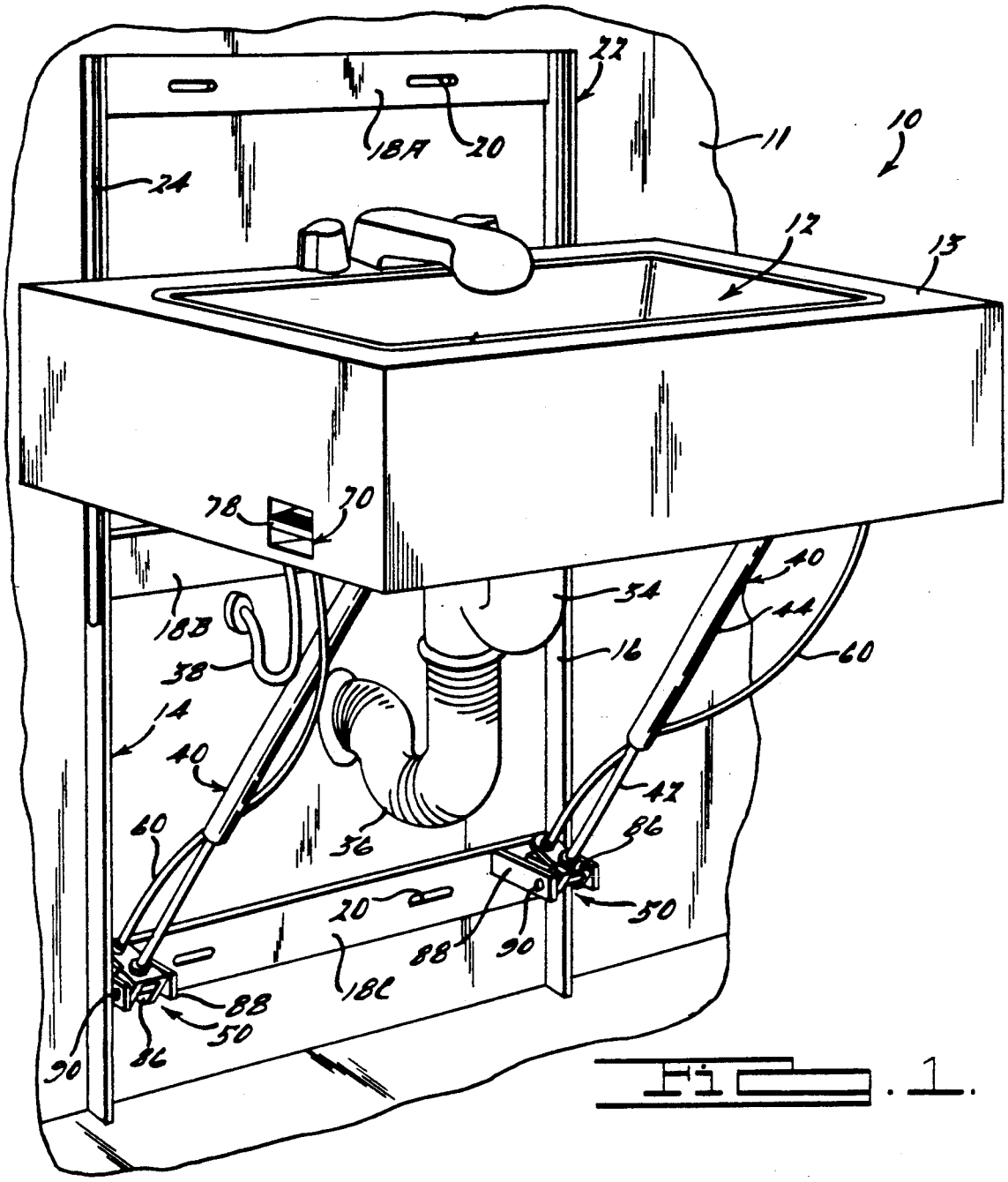
FIG. 1 is a perspective view of a first preferred embodiment of the present invention illustrating the operational association of the various components.

Referring now to FIGS. 1–7 of the drawings, an adjustable vanity assembly is shown and designated with the reference numeral 10. More specifically, FIG. 1 illustrates the adjustable vanity assembly 10 preferably adapted for installation in public or private washrooms, laundry rooms, kitchens, or the like, where a sink assembly 12 is desired. While the preferred embodiment discloses a vertically adjustable sink assembly 12, it is contemplated that the present invention is adapted for application to vanities, counter tops, cutting boards, desks, shelves, utility tables, or other structural construction presenting a work area.

Figure 2:
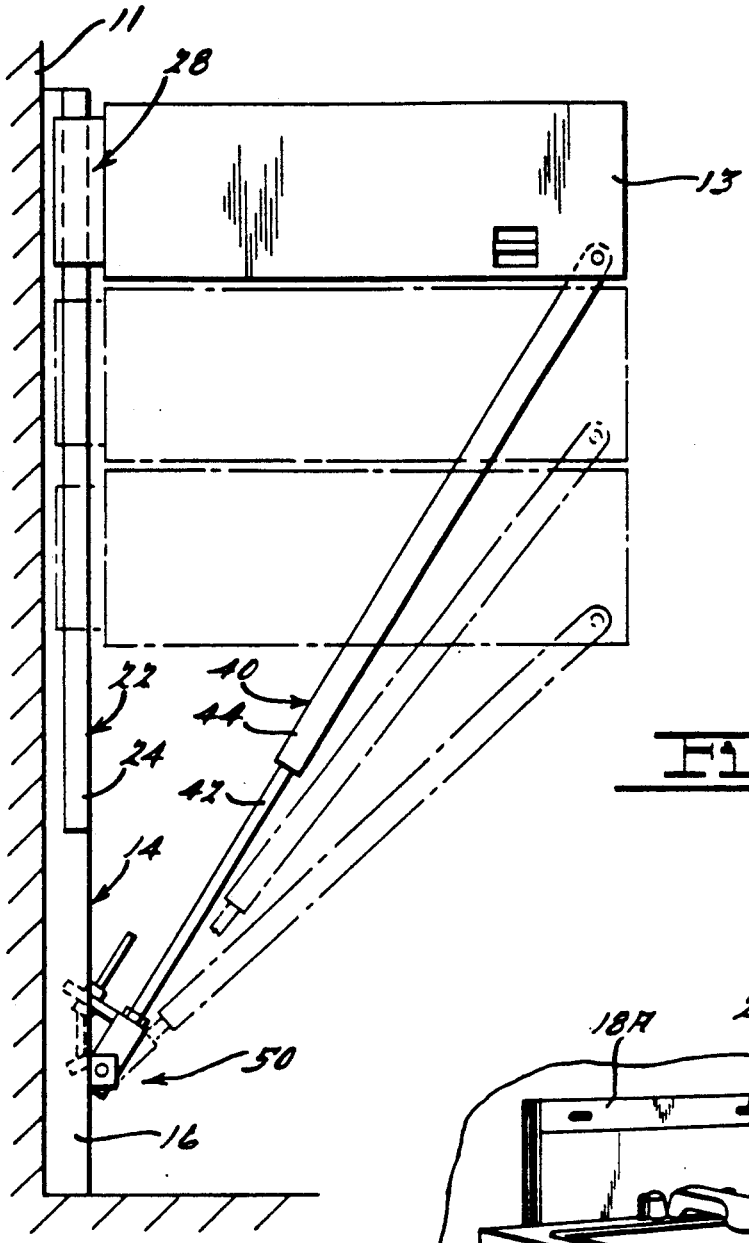
FIG. 2 diagrammatically illustrates the range of vertical adjustment provided by the present invention.
Figure 3:
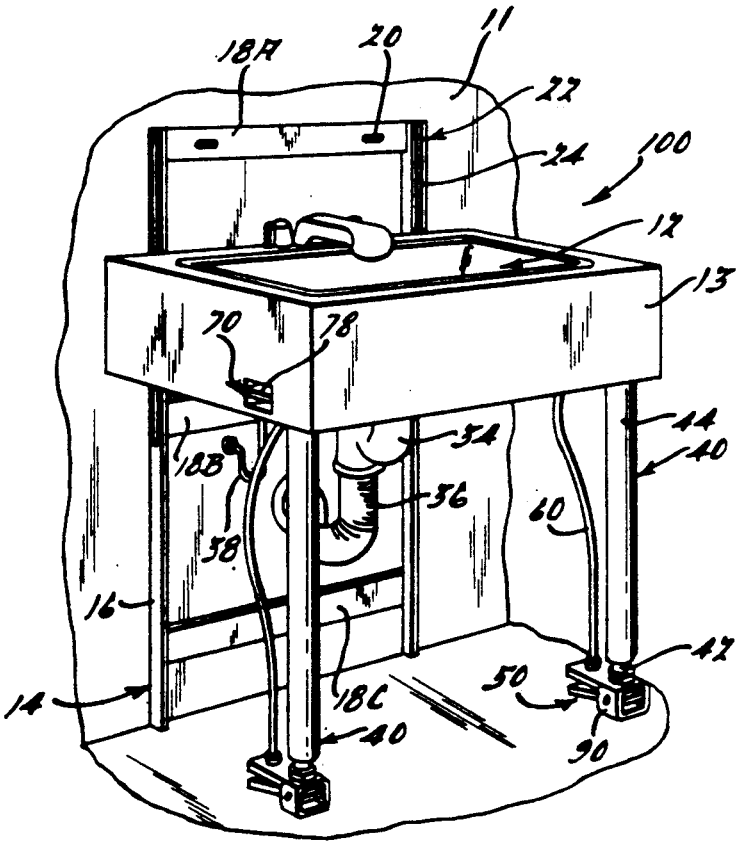
FIG. 3 is a front view of a back plate operatively equipped with a linear motion assembly.
Figure 3:
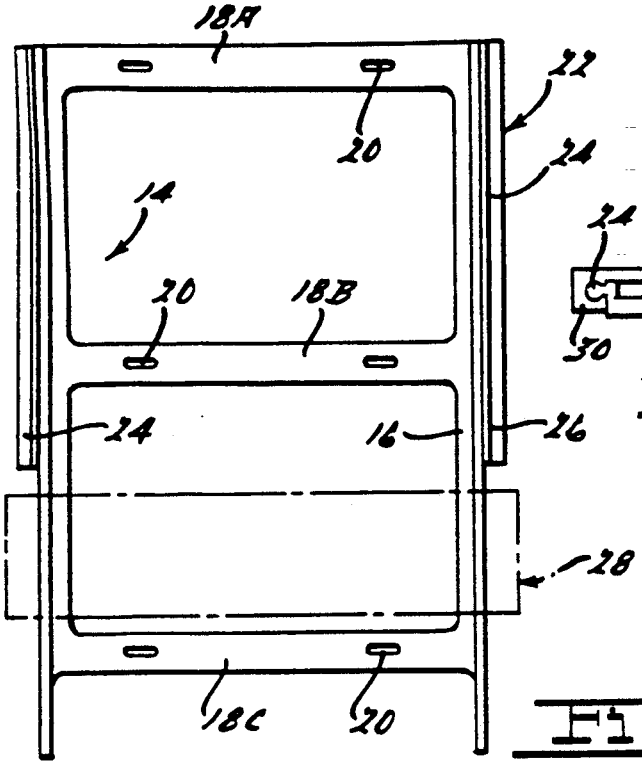
Figure 4:
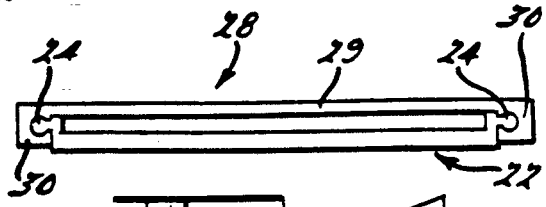
FIG. 4 is a view of FIG. 3 illustrating the operative interaction of the components associated with the linear motion assembly.
Figure 6:
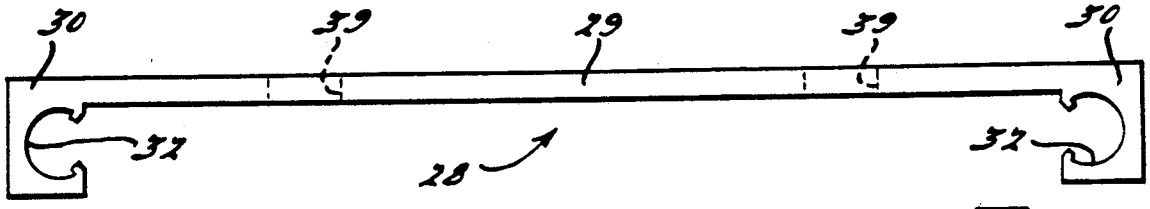
FIG. 6 is an enlarged view of a carriage assembly.

Adjustable vanity assembly 10 provides a predetermined range of continuously variable linear movement of sink assembly 12 between a maximum "extended" position and a minimum "retracted" position with a continuously variable plurality of stops in between. In particular, FIG. 2 diagrammatically illustrates the range of upward "extended" and downward "retracted" reciprocal motion relative to the central standardized vertical position. Vanity assembly 10 functionally interconnects sink assembly 12 to a wall 11 to permit the vertical height between the floor and sink assembly 12 to be controllably varied. According to the embodiments shown, sink assembly 12 is supported in a boxed-in vanity 13 which may be a separate member or an integral extension of the sink. It should be emphasized that the preferred embodiments are merely exemplary in nature and are not intended to limit the present invention to the structure disclosed.

Vanity 13 is coupled for reciprocal vertical movement relative to the floor via a back plate 14. Back plate 14 includes at least two vertically oriented leg members 16 provided in a generally parallel displaced relation. Leg members 16 are maintained in the relative parallel orientation by a plurality of transversely extending support arms 18. Preferably, three support arms 18A–18C are provided in generally evenly spaced transverse relation along back plate 14. Support arms 18 are provided with mounting slots or apertures 20 which are adapted to permit back plate 14 to be mounted flush to vertical wall surface 11.

Figure 5:
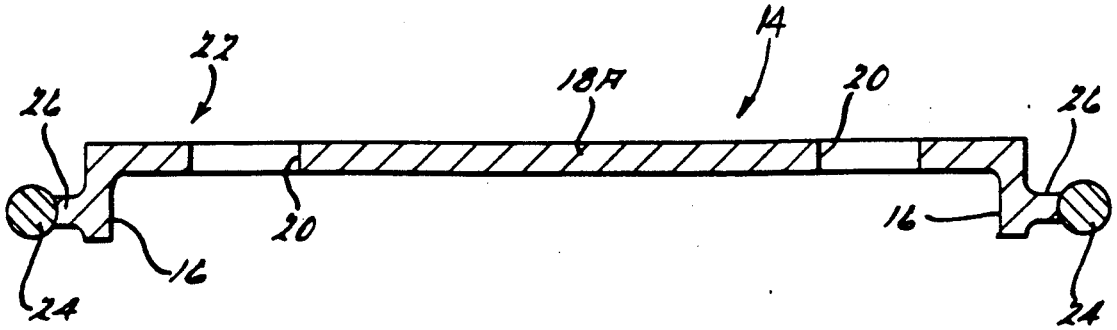
FIG. 5 is an enlarged view of the rail assembly illustrated in FIG. 3.

Referring now in particular to FIGS. 3–6, means are provided to interconnect vanity 13 to back plate 14 for reciprocal movement relative thereto. More specifically, a rail assembly 22 is coupled to an upper portion of back plate 14. Rail assembly 22 includes two elongated rail members 24 mounted to a lateral edge surface of leg members 16. Preferably, rail members 24 are cylindrical in cross-section and of sufficient length to permit a desired range of vertical movement. As illustrated in FIG. 5, rail members 24 are secured, such as by welding, to an extension 26 of back plate leg members 16. While preferably mounted to back plate 14, it is alternatively possible to secure rail members 24 directly to the vertical wall surface 11.

A carriage assembly 28, preferably mounted to a rearmost outer surface of vanity 13, is adapted to engage rails 24. More particularly, carriage assembly 28 includes a plate-like member 29 having a pair of pillow blocks 30 each having an inner surface 32 configured to surroundingly capture rail members 24 thereon. In this manner, the carriage assembly 28 and, consequently, vanity 13 and sink assembly 12 are reciprocally movable relative to rail assembly 22. Bearings (not shown) may be employed to reduce frictional engagement between rails 24 and pillow blocks 30 if the particular applications necessitate their use. Carriage assembly 28 functions to provide a self-centering effect to generate rigidity and parallelism of vanity 13 when it is supported on rail members 24. In this manner, sink assembly 12 is restrained from pivoting relative to rail assembly 22 such that sink assembly 12 is maintained in a relatively transverse perpendicular relation to back plate 14.

Vanity assembly 10 is equipped with a standard S-shaped trap-type drain pipe 34 which is in fluid communication with an outlet (not shown) via a flexible drain pipe section 36. Flexible pipe section 36 permits vertical reciprocal movement of vanity assembly 10 without detrimentally impacting the flow of water from sink assembly 12 to the outlet. Likewise, flexible water inlet hoses 38 (one shown) are used to connect sink assembly 12 to a water source (not shown).

Carriage assembly 28 is provided with at least two bores 39 extending through plate-like member 29 for attaching carriage assembly 28 to a rear exterior surface of vanity 13. While the preferred embodiments illustrate carriage assembly 28 as a unitary one-piece assembly, it is contemplated that separate pillow block devices can be attached to the rear exterior surface of vanity 13 to engage rail members 24 for providing a substantially similar function and operation. Likewise, while the embodiment illustrates rail members 24 mounted as laterally extending relative to leg members 16, it is contemplated that rails 24 may be readily adapted to mount in facing relationship to vanity 13.

Adjustable vanity assembly 10 includes means for selectively permitting and restricting reciprocal movement of vanity 13. Preferably, such means include at least one, and more preferably, two fluid actuated damping devices, such as gas springs 40. Gas springs 40 are adapted to permit vertical movement of vanity 13 in addition to providing a locking function to fixedly restrain vanity 13 at a desired vertical height. Preferably, gas springs 40 are of the type which can be mechanically actuated to transfer pressurized fluid confined within an internal chamber (not shown) provided within tubular housing 44 to opposite sides of a piston (not shown) disposed within the internal chamber. Fluid control means associated with gas springs 40 are provided to generate selective fluid transfer across the piston and may include piston valving such as an internal piston plunger (not shown). The fluid control means is normally closed to restrict fluid flow across the piston such that the fluid pressure on opposite sides of the piston will maintain an equilibrium pressure condition for fixedly maintaining sink assembly 12 at the desired vertical altitude.

Actuation (opening) of the fluid control means permits flow of fluid between opposite sides of the piston whereby piston rod 42 is allowed to move relative to tubular housing 44 through a selected "stroke" to provide the continuously variable adjustment characteristic. Preferably, springs 40 are sized to "expand" for generating upward adjustment movement of vanity 13 without assistance from a human operator. Moreover, the upward movement can be accomplished when sink assembly 12 is full of water and/or when relative lightweight objects are supported on vanity 13. Additionally, springs 40 are preferably designed to "retract" with minimal assistance from the human operator to provide downward height adjustment.

According to the present invention, the opposite ends of gas springs 40 are pivotably coupled between an underside forward surface of vanity 13 (or sink assembly 12 if no vanity is provided) and lower support arm 18C. In this manner, gas springs 40 are permitted to pivot about their ends to account for changes in their effective length during linear reciprocable movement of sink assembly 12.

Figure 7:
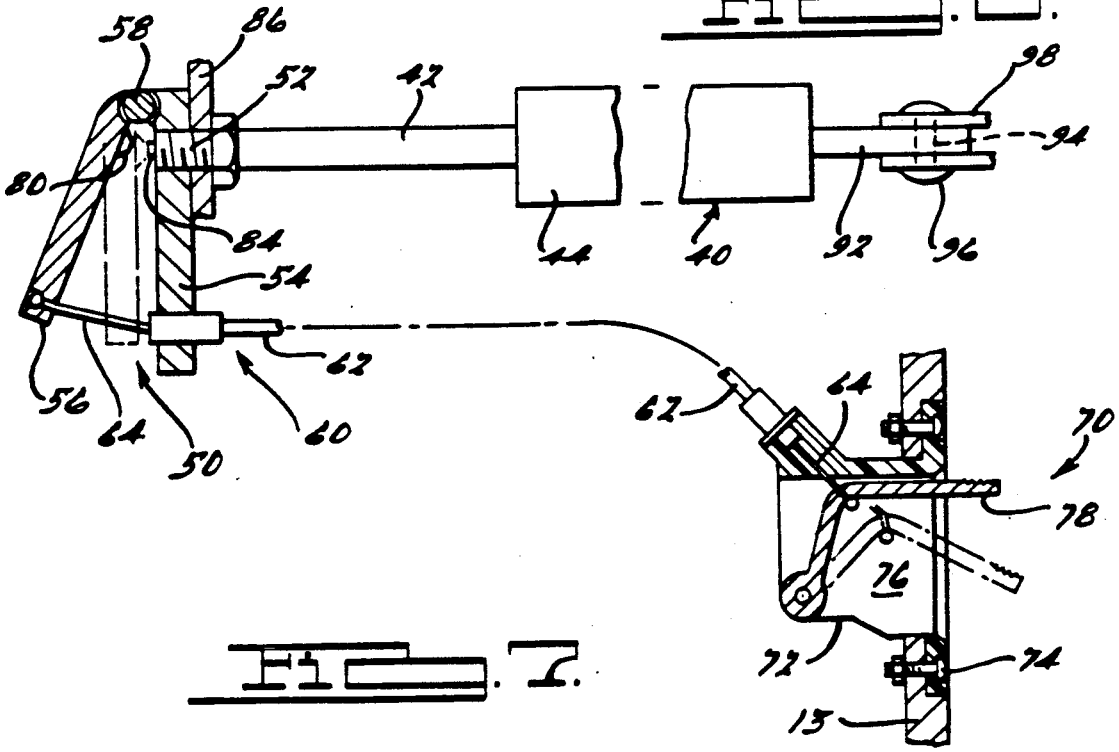
FIG. 7 is a schematic illustration of the actuation means associated with the present invention.

As is illustrated in reference to FIGS. 1 and 7, a hinge assembly 50 is coupled in close association with a first end 52 of piston rod 42. Hinge assembly 50 includes a stationary first member 54 and a movable second member 56 pivotally movable relative to first member 54 about pivot 58 (see FIG. 7). The first end of actuation cable assemblies 60 having an outer sheath 62 is coupled to stationary first member 54 and an axially movable inner core 64 coupled to movable second member 56. Preferably, movable second member 56 is normally biased away from stationary first member 54. Preferably, two actuation cables 60 are provided for selective activation of the separate gas springs 40. The opposite end of cable assemblies 60 is attached to a manually operable switch assembly 70 which includes a housing 72 mounted to vanity 13 as through fasteners 74. Pivotally coupled within cavity 76 of switch assembly 70 to the opposite end of inner core 64 is a switch plate 78 adapted to be movable between a first and second position. Preferably, switch plate 78 is biased to the first position as shown. For convenience, it is contemplated that it is only necessary to provide a single switch assembly 70 for generating movement of the inner core 64 associated with both cable assemblies 60.

In operation, a human operator pivots switch plate 78 to the second position (shown in phantom in FIG. 7) to axially move inner core member 64 relative to outer sheath 62. Such movement of inner core member 64 urges second member 56 to pivot in a direction toward stationary first member 54. In this manner, a nib 80 provided on movable second member 56 actuates the fluid control means. In particular, nib 80 engages an actuation plunger 84 associated with the fluid control means of gas springs 40. Continued engagement of nib 80 urges actuation plunger 84 extending through first end 52 of rod 42 to move internal valving (not shown) associated with gas springs 40 which permits fluid communication of the pressurized fluid contained therein between opposite sides of the piston. Thereafter, vanity 13 and, consequently, sink assembly 12 move vertically in an upward "extended" direction in an unrestrained fashion. Upon release of switch plate 78, movable second member 56 and nib 80 are biased to pivot out of engagement with actuation plunger 84 thereby closing the valving within gas springs 40. In this manner, fluid communication between opposite sides of the piston is inhibited such that a pressurized fluid equilibrium state is generated on opposite sides of the piston to provide the "locking effect" of springs 40 thereby restraining vanity 13 in the desired vertical position. It is contemplated that springs 40 will be sized to support at least the weight of a human so as to maintain the desired vertically adjusted position despite being loaded (i.e. "leaned" upon).

To lower sink assembly 12, switch plate 78 is again pivoted to the second position and a downwardly directed force is applied on a top surface of vanity 13 by the human operator. The applied force mechanically "retracts" piston rod 42 relative to tubular housing 44 so as to urge sink assembly 12 downwardly to a desired position. Release of switch plate 78 will again lock sink assembly 12 in the desired vertical position. Preferably, the downward force required for moving vanity 13 in a downward direction is sufficiently low to facilitate use by even the most feeble operators. The above-described fluid control means method of actuation are exemplary in nature and are not to be construed as limiting relative to the present invention. Any means for remote actuation, manual or automatic, known in the industry for selectively controlling the displaced "retracted" or "extended" stroke of a rod 42 of a shock absorber, damper or the like or any other force generating device is contemplated.

First end 52 of rod 42 is attached to hinge assembly 50 via a generally U-shaped bracket 86 which is pivotably secured between spaced flange members 88 extending from lower support arm 18C by pivot pin 90. While the embodiment illustrates utilization of flange members 88 to pivotably support U-shaped bracket 86 and hinge assembly 50, it is contemplated that bracket 86 could be easily mounted directly to leg members 16. An upper portion of tubular housing 44 is provided with a mounting flange 92 having a bore 94 which is pivotably coupled via pin 96 to a clevis-type structure 98 mounted to the underside of vanity 13.

Referring now to FIG. 8 another embodiment of the present invention is illustrated. Like numbers are used to designate like components herebefore described. In general, FIG. 8 illustrates an adjustable sink assembly 100 which is substantially similar in function and operation to that previously described, except that gas springs 40 are vertically mounted between the floor and vanity 13. In this manner, the components associated with pivotally mounting opposite ends of gas springs 40 can be eliminated. Hinge assembly 50 would be adapted to be mounted to the floor to provide the means of actuating springs 40 as previously described. FIG. 8 illustrates the commonality of components between the two embodiments herebefore described. As is apparent, the second embodiment uses many components identical to those applicable for use with the first embodiment.

Those skilled in the art can appreciate that other features and advantages can be obtained from the use of this invention and that modifications can be made without departing from the true spirit of the invention after studying the specification, drawings and the following claims.

What is claimed is:

1. A height-adjustable sink assembly comprising:

a sink;

reciprocable motion means for enabling said sink to move generally parallel to a stationary wall surface for adjusting the height of said sink relative to a floor surface, said reciprocable motion means adapted to connect said sink to said stationary wall surface;

force generating means for selectively permitting and restricting movement of said sink, said force generating means comprises at least one internally pressurized fluid device having a sealed tubular housing connected at one end thereof to said sink and defining an internal chamber therein and a piston rod, said piston rod having a piston at one end disposed for movement within said internal chamber and a second end attached to one of said stationary wall surface and said floor surface; and actuation means adapted for inhibiting movement of said force generating means when said actuation means is in a first position and for permitting movement of said force generating means when said actuation means is in a second position, said actuation means comprises a switch assembly having a switch member movable between said first and second positions and an actuation cable means adapted for interconnecting said movable switch member and said fluid control means for selectively actuating said fluid control means in response to movement of said switch member, said force generating means providing continuously variable height adjustment of said sink relative to said floor surface through a predetermined range of reciprocal motion when said actuation means is in said second position and said tubular housing attached to said sink, said pressurized fluid device further comprising fluid control means selectively actuated by said actuation means for selectively permitting reciprocable movement of said piston rod relative to said tubular housing when said actuation means is in said second position and restricting movement of said piston rod when said actuation means is in said first position.

2. The height-adjustable sink assembly of claim 1 wherein said reciprocable motion means comprises a rail assembly fixedly secured to said stationary wall surface and a movable carriage member secured to a rearward surface of said sink, said carriage member adapted for slidingly engaging said rail assembly for movement relative thereto such that movement of said carriage member generates corresponding reciprocal movement of said sink.

3. The height-adjustable sink assembly of claim 2 wherein said stationary wall surface further comprises a back plate adapted to support said rail assembly thereon, and wherein said back plate is adapted to be contiguously secured to a vertically extending wall.

4. The height-adjustable sink assembly of claim 3 wherein said rail assembly includes a pair of elongated rods secured to said back plate.

5. The height-adjustable sink assembly of claim 4 wherein said movable carriage member comprises first and second pillow block devices adapted to surroundingly capture said elongated rods, said first and second pillow block devices mounted to a rearward exterior surface of said sink such that said sink is thereby connected to said elongated rods for reciprocal movement relative thereto.

6. The height-adjustable sink assembly of claim 4 wherein said movable carriage member comprises a plate-like portion having first and second pillow blocks provided at opposite ends thereof, said pillow blocks adapted to surroundingly capture said elongated rods for movement relative thereto, said carriage member fixedly secured to a rearward exterior surface of said sink.

7. The height-adjustable sink assembly of claim 1 wherein said switch further includes biasing means for biasing said switch member to said first position.

8. The height-adjustable sink assembly of claim 1 wherein said pressurized fluid device comprises a pair of gas springs such that movement of said switch member to said second position actuates said fluid control means to increase the length of said piston rod extending from said tubular housing to raise the adjusted height of said sink, and wherein movement of said switch member to said first position de-actuates said fluid control means for lockingly restraining said sink at a desired height position.

9. The height-adjustable sink assembly of claim 8 wherein movement of said switch member to said second position combined with a predetermined downward force applied to said sink acts to decrease the length of said piston rod extending from said tubular housing to lower the adjusted height of said sink.

10. The height-adjustable sink assembly of claim 9 wherein said sink includes a vanity surrounding said wash basin.

11. A height-adjustable sink assembly adapted to be secured to a generally wall comprising:

a sink;

a vanity supporting said sink;

a back plate adapted to be mounted to said vertical wall;

rail means fixedly secured to said back plate in a generally planar orientation relative to said vertical wall;

carriage means for permitting reciprocal movement of said sink relative to said rail means, said carriage means secured to a rearward surface of said vanity and adapted to capture said rail means;

gas spring means for providing linear reciprocal movement of said carriage means relative to said rail means, said gas spring means coupled between said vanity and one of said back plate and a floor surface and having a tubular housing defining an internal fluid chamber and an axially movable piston and rod assembly disposed within said chamber, said gas spring means having fluid flow control means for selectively increasing and decreasing the length of said piston rod extending from said housing to permit continuously variable height adjustment of said sink through a predetermined range of reciprocal motion; and remote actuation means for selectively actuating said fluid flow control means such that actuation of said fluid flow control means permits reciprocal movement of said piston and rod assembly for adjusting the height of said vanity and said sink, said remote actuation means comprises a switch assembly having a switch member movable between a first position and a second position and an actuation cable assembly adapted to interconnect said movable switch member and said fluid flow control means for selectively actuating said fluid control means in response to movement of said switch member, and wherein deactuation of said fluid flow control means inhibits movement of said piston and rod assembly to maintain said vanity and said sink in a desired height position.

12. The height-adjustable sink assembly of claim 11 wherein said rail means includes a pair of elongated rods secured to said back plate.

13. The height-adjustable sink assembly of claim 12 wherein said carriage means comprises first and second pillow block devices adapted to engage said elongated rods, said first and second pillow block devices mounted to a rearward exterior surface of said vanity such that said vanity is adapted for reciprocal movement onto said elongated rods.

14. The height-adjustable sink assembly of claim 12 wherein said carriage means comprises a plate-like portion having first and second pillow blocks at opposite ends thereof, said pillow blocks adapted to engage said elongated rods for reciprocal movement relative thereto, said carriage means fixedly secured to a rearward exterior surface of said vanity.

15. The height-adjustable sink assembly of claim 11 wherein movement of said switch member to said second position actuates said fluid flow control means to increase the length of said piston and rod assembly extending from said tubular housing to raise the adjusted height of said sink and vanity, and wherein movement of said switch member to said first position deactuates said fluid flow control means to lockingly inhibit movement of said piston and rod assembly, said switch member being normally biased to said first position.

16. The height-adjustable sink assembly of claim 11 wherein movement of said switch member to said second position combined with a predetermined downward force applied to said sink acts to decrease the length of said piston and rod assembly extending from said tubular housing thereby lowering the adjusted height of said sink.

* * * * *